US010906045B2

(12) United States Patent
Simons et al.

(10) Patent No.: US 10,906,045 B2
(45) Date of Patent: Feb. 2, 2021

(54) DIMENSIONALLY STABLE RING ELEMENT FOR A HEAT EXCHANGER CASING

(71) Applicant: Willy A. Bachofen AG, Muttenz (CH)

(72) Inventors: Benedikt Simons, Schopfheim (DE); Lionel Gross, Rouffach (FR); Guillaume Martin, Habsheim (FR)

(73) Assignee: Willy A. Bachofen AG, Muttenz (CH)

( * ) Notice: Subject to any disclaimer, the term of this patent is extended or adjusted under 35 U.S.C. 154(b) by 310 days.

(21) Appl. No.: 15/954,966

(22) Filed: Apr. 17, 2018

(65) Prior Publication Data

US 2018/0297035 A1 Oct. 18, 2018

(30) Foreign Application Priority Data

Apr. 18, 2017 (EP) ..... 17166864

(51) Int. Cl.
*B02C 17/16* (2006.01)
*B02C 17/18* (2006.01)

(52) U.S. Cl.
CPC ..... *B02C 17/1815* (2013.01); *B02C 17/16* (2013.01)

(58) Field of Classification Search
CPC ... B02C 17/16; B02C 17/163; B02C 17/1815; B02C 17/1825
See application file for complete search history.

(56) References Cited

U.S. PATENT DOCUMENTS 3,998,262 A * 12/1976 Didion ..... B22C 5/085 164/131
4,174,074 A 11/1979 Geiger
4,371,119 A 2/1983 Leuthold
4,624,418 A * 11/1986 Szkaradek ..... B02C 17/161 241/172
4,915,307 A 4/1990 Klimaschka et al.
5,379,952 A 1/1995 Geiger
(Continued)

FOREIGN PATENT DOCUMENTS

DE 26 34 835 2/1978
DE 29 20 758 7/1980
(Continued)

OTHER PUBLICATIONS

Office Action issued by European Patent Office in European Application No. 17166864.3 dated Oct. 12, 2017.
(Continued)

*Primary Examiner* — Faye Francis
(74) *Attorney, Agent, or Firm* — Weiss & Arons LLP

(57) ABSTRACT

A dimensionally stable ring element (1, 2) for a heat exchanger casing (3) includes:

a cylindrical sleeve (10, 20) having a cylinder axis (102, 202), a first end (104, 204) and a second end (106, 206) remote from the first end, and having an inner wall (108, 208), a dividing wall (11, 21) which projects inwards from the inner wall (108, 208) of the sleeve (10, 20) and extends helically around the cylinder axis (102, 202) along the inner wall (108, 208) from the first end (104, 204) of the sleeve (10, 20) to the second end (106, 206) of the sleeve (10, 20).

At its first end (104, 204) the sleeve (10, 20) includes a projection (109, 116, 209, 216) extending parallel to the cylinder axis (102, 202), which projection is arranged in a predetermined circumferential position on the sleeve (10, 20).

12 Claims, 4 Drawing Sheets

(56) References Cited

U.S. PATENT DOCUMENTS

| | | | | |
|---|---|---|---|---|
| 5,758,833 | A * | 6/1998 | Kabbe | B02C 17/16 241/171 |
| 5,794,865 | A * | 8/1998 | Didion | B22C 5/0459 164/404 |
| 6,273,176 | B1 * | 8/2001 | Didion | B22D 31/007 164/131 |
| 10,668,478 | B2 * | 6/2020 | Didion | B02C 17/1825 |
| 2010/0025508 | A1 * | 2/2010 | Didion | B02C 17/06 241/74 |
| 2010/0044276 | A1 * | 2/2010 | Marks | B02C 17/1825 208/390 |
| 2013/0105607 | A1 * | 5/2013 | Yoshikawa | B02C 13/288 241/57 |
| 2014/0263768 | A1 * | 9/2014 | Noge | B02C 13/10 241/23 |

FOREIGN PATENT DOCUMENTS

| | | |
|---|---|---|
| DE | 37 23 558 | 1/1989 |
| DE | 20 2015 101 859 | 5/2015 |
| GB | 2040729 B | 1/1983 |
| JP | 5318861 | 2/1978 |
| JP | 53136762 | 11/1978 |
| JP | 5594631 | 7/1980 |
| JP | 7124491 | 5/1995 |
| JP | 1062087 | 3/1998 |
| JP | 2016-53469 | 4/2016 |
| WO | WO2017/038962 | 3/2017 |

OTHER PUBLICATIONS

Google Patents English translation of DE202015101859.
Google Patents English translation of DE2634835.

* cited by examiner

DIMENSIONALLY STABLE RING ELEMENT FOR A HEAT EXCHANGER CASING

The present invention relates to a dimensionally stable ring element for a heat exchanger casing, to a heat exchanger casing having a plurality of such ring elements, and to an agitator ball mill having such a heat exchanger casing.

Agitator ball mills have applications in many fields, but especially in those fields in which a material is to be ground especially finely, such as, for example, in the case of pigment processing in the paints and coatings industry. With the aid of an agitator ball mill, colour pigments and fillers are comminuted therein to a very small particle size (for example nanoparticles) and dispersed. The grinding process generates heat in the grinding container of the agitator ball mill. In order to achieve the best possible grinding result it can be advantageous to be able to dissipate or recover excess heat or to enable a desired temperature regime to be implemented for the grinding process. For that reason, agitator ball mills can be provided with a heat exchanger casing through which a heat transfer medium is able to flow, with the result that a desired temperature regime can be implemented for the grinding process. A controlled temperature regime for processes in containers can also be desirable in many other applications and is therefore not limited to grinding processes or agitator ball mills.

In a known agitator ball mill, the heat exchanger casing is in the form of a one-piece hollow-cylindrical sleeve (for example made of stainless steel) which extends over the entire length of the grinding container and encompasses the latter. The inner wall of the hollow-cylindrical sleeve is provided with a groove which runs helically from one end of the sleeve to the other. A flexible dividing wall is secured in the groove, the inner end of which dividing wall rests against the grinding container so that a channel running helically around the grinding container is formed. Both the introduction of the helical groove and the attachment of the flexible dividing wall is laborious and requires cost-intensive manufacturing processes.

Since, during cooling or heating, a heat transfer medium (for example water) flows through the helical channel, over time deposits may be formed which can have an adverse effect on the temperature regime and therefore have to be removed. The dividing wall can also undergo wear over time, so that it needs to be exchanged, because otherwise the heat transfer medium will no longer flow uniformly through the helical channel around the grinding container. Both the removal of such deposits and the exchange of the dividing wall are very laborious, because for that purpose first the hollow-cylindrical sleeve extending over the entire length of the grinding container has to be completely stripped off the grinding container, which can be a difficult procedure because the deposits make it more difficult or even impossible to strip off the hollow cylinder without at the same time causing damage to the dividing wall. Exchanging the dividing wall is very labour-intensive, because for that purpose the new dividing wall needs to be laboriously pressed into the helical groove over its entire length along the inner wall of the hollow cylinder, which, on the one hand, is a difficult manual task and, on the other hand, is extremely time-consuming.

The invention is to provide a remedy in this regard and to eliminate the disadvantages mentioned above.

This object is achieved by the dimensionally stable ring element for a heat exchanger casing according to the invention, as it is defined by the features of independent claim 1. Advantageous aspects of the dimensionally stable ring element according to the invention are apparent from the features of the corresponding dependent claims.

According to the invention there is proposed a dimensionally stable ring element for a heat exchanger casing which comprises the following:

- a cylindrical sleeve having a cylinder axis, a first end and a second end remote from the first end, and having an inner wall,
- a dividing wall which projects inwards from the inner wall of the sleeve and extends helically around the cylinder axis along the inner wall from the first end of the sleeve to the second end of the sleeve.

At its first end the sleeve comprises a projection extending parallel to the cylinder axis, which projection is arranged in a predetermined circumferential position on the sleeve. At its second end the sleeve comprises a recess extending parallel to the cylinder axis, which recess has a shape complementary to the projection and is arranged on the sleeve in the same predetermined circumferential position as the projection.

The term "dimensionally stable" in relation to the ring element means that the ring element as a whole, that is to say considered as a complete component, does not change its external shape when the ring element is used as intended, that is to say its shape is stable. That does not mean that individual parts of the ring element cannot be deformable (for example the dividing wall can have a flexible and therefore deformable sealing lip, but it need not; see discussion hereinbelow), but the ring element as a whole is stable in external shape when the ring element is used as intended.

Such a dimensionally stable ring element allows particularly simple assembly and disassembly of a quasi-modular heat exchanger casing which is formed from a plurality of individual dimensionally stable ring elements arranged one after the other in a row, and, in addition, renders the laborious replacement of the dividing wall obsolete. The projection and the recess provide a positioning aid during assembly. Such a positioning aid allows simple, error-free, quick and positionally correct assembly of a plurality of such ring elements one after the other in a row in order to form a heat exchanger casing. Moreover, because they are complementary in shape, the projection and the recess allow interlocking engagement between a plurality of such ring elements arranged one after the other in a row. As a result, the individual ring elements of the heat exchanger casing can be prevented from twisting relative to one another. In the event of the dividing wall of an individual ring element being damaged, only the damaged ring element needs to be replaced during maintenance of the heat exchanger casing, thus rendering the manually laborious and time-consuming exchange of the dividing wall obsolete. Maintenance is accordingly limited to the replacement of the particular ring elements that are damaged, which can be done easily without requiring a large amount of time.

In accordance with one aspect of the dimensionally stable ring element according to the invention, the projection at the first end of the sleeve has a tooth having a tooth length and a tooth width, and the recess at the second end of the sleeve has a notch having a notch depth and a notch width. The tooth has a shape complementary to the notch; the tooth length corresponds to the notch depth and the tooth width corresponds to the notch width.

The tooth and the notch complementary thereto allow simple and reliable interlocking engagement of ring elements arranged one after the other in a row. In that way, two ring elements arranged one after the other in a row are prevented from twisting relative to one another. The dimensions of the notch are such that the tooth can be inserted into the notch during assembly and removed from the notch during disassembly. Moreover, the combination of tooth and notch allows simple and quick identification of the correct assembly position.

In accordance with a further aspect of the dimensionally stable ring element according to the invention, the projection at the first end of the sleeve comprises an overhang extending along the circumference of the sleeve, which overhang has an overhang length in the direction of the circumference of the sleeve and an overhang width in the direction of the cylinder axis. The recess at the second end of the sleeve comprises a cutaway extending in the direction of the circumference of the sleeve, which cutaway has a cutaway length in the direction of the circumference of the sleeve and a cutaway depth in the direction of the cylinder axis. The overhang has a shape complementary to the cutaway, and the overhang length corresponds to the cutaway length and the overhang width corresponds to the cutaway depth.

The overhang, which extends along the circumference of the sleeve, and the cutaway, which is complementary in shape thereto and likewise extends along the circumference of the sleeve, likewise allow torsion-resistant interlocking engagement of ring elements arranged one after the other in a row and also fix the positionally correct arrangement of the individual ring elements relative to one another.

In accordance with a further aspect of the dimensionally stable ring element according to the invention, the dividing wall extends helically around the cylinder axis from the overhang at the first end of the sleeve to the cutaway at the second end of the sleeve, the dividing wall having a dividing wall width extending parallel to the cylinder axis, which dividing wall width is smaller than or equal to the overhang width.

A width of the dividing wall that is so predetermined relative to the width of the overhang (or correspondingly relative to the depth of the cutaway) enables the dividing wall of a ring element to rest with the beginning of the dividing wall that is located at the overhang congruently against the end of the dividing wall at the cutaway of a ring element arranged directly adjacent in the row, so that an as it were helical uninterruptedly continuous dividing wall is formed.

In accordance with a further aspect of the dimensionally stable ring element according to the invention, the dividing wall has a flexible sealing lip at its end remote from the inner wall of the sleeve.

During mounting of the ring element or the heat exchanger casing composed of a plurality of such ring elements, the flexible sealing lip is able to come to rest against the container wall of the processing container or grinding container, with the result that an optimum sealing action is achieved.

In accordance with a further aspect of the dimensionally stable ring element according to the invention, the sleeve is made from a first material having a first modulus of elasticity and the dividing wall is made from a second material having a second modulus of elasticity, the first modulus of elasticity of the material of the sleeve being greater than the second modulus of elasticity of the material of the dividing wall.

This makes it possible for the dividing wall to be bent during mounting and thus to be able to rest firmly against the processing container or grinding container, while the sleeve, and accordingly the ring element considered as a whole, remains stable in respect of its external shape. For example, the first material, from which the sleeve is made, can be polyamide or fibre-reinforced polyamide. The second material, from which the dividing wall is made, can be, for example, a thermoplastic elastomer. Both the first material, from which the sleeve is made, and the second material, from which the dividing wall is made, are, for example, injection-mouldable materials.

For example, in accordance with a further aspect of the dimensionally stable ring element according to the invention, the sleeve made from the first material with the dividing wall made from the second material is manufactured by a two-component injection-moulding process. A dividing wall manufactured in that way has a contour matched to the contour of the container wall of the processing container or grinding container. As a result of being produced by means of an injection-moulding process, the contact surface of the dividing wall which comes into contact with the container wall of the processing container or grinding container remains free of folds, so that the heat transfer medium flows uniformly through the channel around the processing container or grinding container, while in the case of pressed-in dividing walls, as known from the prior art, such fold formation can occur.

With the aid of a two-component injection-moulding process it is possible to manufacture the dimensionally stable ring element according to the invention in an economical, reliable and time-saving way. Accordingly, the dividing wall need not be incorporated into the sleeve in a separate working step, but instead, with the aid of such a two-component injection-moulding process, the ring element can be manufactured immediately as a complete component. Accordingly, when exchange is necessary, only the ring element according to the invention that needs to be exchanged is replaced by a new ring element, which is cost-efficient (advantageous production of the ring element; time-saving and manually simple replacement of a worn ring element by a new ring element). Moreover, the amount of time required for exchange, during which time the processing container is idle, is also comparatively short.

In accordance with another aspect of the dimensionally stable ring element according to the invention, the dividing wall is in the form of a dimensionally stable bead running helically around the cylinder axis, which bead projects inwards from the inner wall of the sleeve. The term "dimensionally stable" in relation to the bead again means that when the ring element is used as intended, the bead does not change its shape, that is to say its shape is stable.

A dividing wall having such a dimensionally stable bead is robust and resistant to wear. On the other hand, the dimensionally stable bead needs to be produced so that it is not able to rest against the container wall but instead a small radial gap remains between the container wall and the dividing wall. Otherwise the dimensionally stable bead can be damaged during mounting (for example it can break).

In accordance with a further aspect of the dimensionally stable ring element according to the invention, in such a case the sleeve and the dividing wall can be made from the same material with the aid of a one-component injection-moulding process.

The one-component injection-moulding process is an especially economical, reliable and time-saving way of producing the dimensionally stable ring element according to the invention.

According to the invention there is further proposed a heat exchanger casing in which a plurality of dimensionally stable ring elements according to the invention, as described above, are arranged one after the other in a row, wherein the projection of a ring element that is arranged subsequently in the row engages interlockingly in the recess of the respective preceding ring element in the row.

In such a heat exchanger casing, the ring elements arranged one after the other in a row cannot twist relative to one another, they are accordingly arranged so as to be torsion-resistant. This is achieved by interlocking engagement between the projection of a forward ring element in the row and the recess of the respective subsequent rear ring element. Furthermore, such a heat exchanger casing is economical to maintain, because it may not be necessary to exchange all the ring elements of the heat exchanger casing, but rather it is possible to exchange only ever those ring elements that actually need replacement. Moreover, such a heat exchanger casing is quick to assemble, because the dividing wall of the ring elements does not need to be laboriously inserted into the heat exchanger casing, but is already integrated in the ring elements.

As already mentioned, application is possible in principle for many types of processing containers, but especially for agitator ball mills. According to the invention there is therefore also proposed an agitator ball mill which comprises

- a grinding container having a cylindrical container wall and
- a heat exchanger casing according to the invention as described above.

The heat exchanger casing is arranged around the container wall, so that a helical channel is formed by the dividing walls of the ring elements of the heat exchanger casing extending helically around the cylinder axis and by the container wall.

The agitator ball mill according to the invention further comprises

- an inlet and an outlet for a heat transfer medium, the inlet being connected to a first end of the helical channel and the outlet being connected to a second end of the helical channel of the heat exchanger casing, which second end is remote from the first end.

Such an agitator ball mill has the advantage that it is simple to assemble and maintain. Furthermore, such an agitator ball mill allows an efficient temperature regime for the process in the grinding container. During assembly, the heat exchanger casing can be mounted on the grinding container in a simple way by inserting the grinding container into the heat exchanger casing, which is composed of the assembled ring elements arranged one after the other in a row, or by pushing the heat exchanger casing over the grinding container. For maintenance, the heat exchanger casing can be demounted from the grinding container in reverse order (withdrawal of the grinding container from the heat exchanger casing or removal of the heat exchanger casing from the grinding container). The arrangement of the heat exchanger casing around the container wall allows an optimum exchange of heat between the grinding container and a heat transfer medium flowing through the heat exchanger casing, because the channel for conducting the heat transfer medium is formed in such a way that the heat transfer medium comes directly into contact with the container wall of the grinding container. Depending upon the application, the heat transfer medium can serve as a cooling medium or as a heating medium.

In accordance with a further aspect of the agitator ball mill according to the invention, the latter further comprises a cylindrical outer cover which encompasses the heat exchanger casing.

The cylindrical outer cover allows the stability of the heat exchanger casing to be additionally increased, because it encompasses the heat exchanger casing and therefore additionally holds the individual ring elements in position. There is preferably a small amount of radial play between the heat exchanger casing and the cylindrical outer cover, which allows the ring elements of the heat exchanger casing to be pushed into the cylindrical outer cover, and subsequently allows the grinding container to be pushed into the heat exchanger casing with the encompassing cylindrical outer cover or allows the heat exchanger casing arranged in the cylindrical outer cover to be pushed over the grinding container.

In accordance with one aspect of the agitator ball mill according to the invention, the latter comprises a heat exchanger casing according to the invention composed of ring elements having a dividing wall with a flexible sealing lip as described above. The flexible sealing lip has an inner edge having an internal diameter and the container wall of the grinding container has an external diameter. The internal diameter of the sealing lip is smaller than the external diameter of the container wall of the grinding container, so that the flexible sealing lip is bent and rests against the container wall of the grinding container.

Preferably the sealing lip is bent in a direction opposite to the flow direction of the heat transfer medium through the helical channel. As a result, during operation the sealing lip is pressed even more firmly against the container wall by the heat transfer medium, so that the helical channel is well sealed and, during operation, the heat transfer medium is accordingly able to flow uniformly through the helical channel without leakage, with the result, in turn, that a good and uniform exchange of heat between the container wall and the heat transfer medium can take place.

In accordance with another aspect of the agitator ball mill according to the invention, the latter has a heat exchanger casing according to the invention composed of ring elements having a dividing wall with a dimensionally stable bead as described above. The dimensionally stable bead has an inner edge having an internal diameter and the container wall of the grinding container has an external diameter. The internal diameter of the bead is larger than the external diameter of the container wall of the grinding container, so that a gap is formed between the inner edge of the bead and the container wall of the grinding container.

As a result of that difference in diameter between the bead and the container wall of the grinding container, the dimensionally stable bead does not rest against the container wall, otherwise the bead could be damaged during mounting of the heat exchanger casing (see discussion above). Accordingly, the heat exchanger casing can readily be removed from the grinding container during demounting.

The mounting of the heat exchanger casing on the agitator ball mill can be carried out, for example, as follows: first of all, all the ring elements are aligned in the same circumferential position in relation to the cylindrical outer cover and inserted into the cylindrical outer cover interlockingly one after the other in a row. In that procedure the projection and the recess of the respective ring element serve as positioning aids. After insertion of the ring elements into the cylindrical outer cover, the projection of a rear ring element in the row engages interlockingly in the recess of a respective forward ring element arranged immediately in front of that rear ring element in the row. The ring elements arranged in that way one after the other in the row thus form the heat exchanger casing. Then the grinding container is inserted into the heat exchanger casing, which is surrounded by the cylindrical outer cover, or the heat exchanger casing arranged in the cylindrical outer cover is pushed over the grinding container.

That means that in the case of ring elements having a dividing wall with a flexible sealing lip, the flexible sealing lip of the respective ring element is bent and rests against the container wall of the grinding container, so that a sealed helical channel is formed. In the case of ring elements having a dividing wall with a dimensionally stable bead, the bead does not touch the container wall, so that here a small radial gap remains between the container wall and the dividing wall, but likewise the helical channel is formed. For maintenance, the grinding container is withdrawn from the heat exchanger casing or the heat exchanger casing arranged in the cylindrical outer cover is removed from the grinding container. The ring elements of the heat exchanger casing are then taken out of the outer cover of the agitator ball mill and the worn ring elements are replaced by corresponding new ring elements (or, in principle, all ring elements are replaced during maintenance). Re-assembly is then carried out as already described.

The invention is described in greater detail below on the basis of exemplary embodiments and with reference to the accompanying drawings, wherein, in partly diagrammatic form:

The following considerations apply in respect of the description which follows: where, for the purpose of clarity of the drawings, reference symbols are included in a Figure but are not mentioned in the directly associated part of the description, reference should be made to the explanation of those reference symbols in the preceding or subsequent parts of the description. Conversely, to avoid over-complication of the drawings, reference symbols that are less relevant for immediate understanding are not included in all Figures. In that case, reference should be made to the other Figures.

Figure 1:
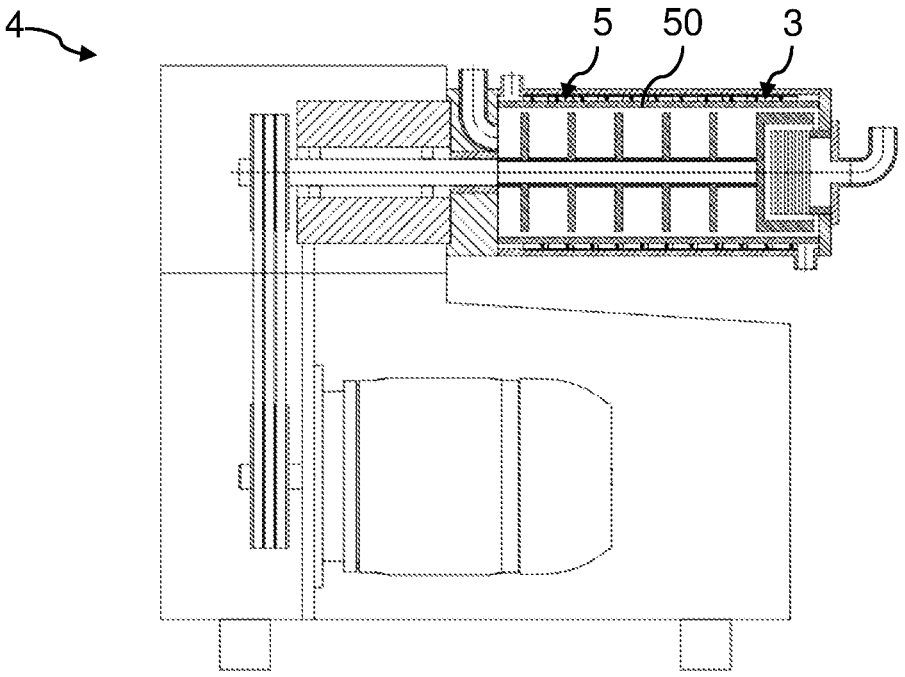
FIG. 1 shows a longitudinal section through an agitator ball mill according to the invention having a heat exchanger casing according to the invention with dimensionally stable ring elements according to the invention.
Figure 2:
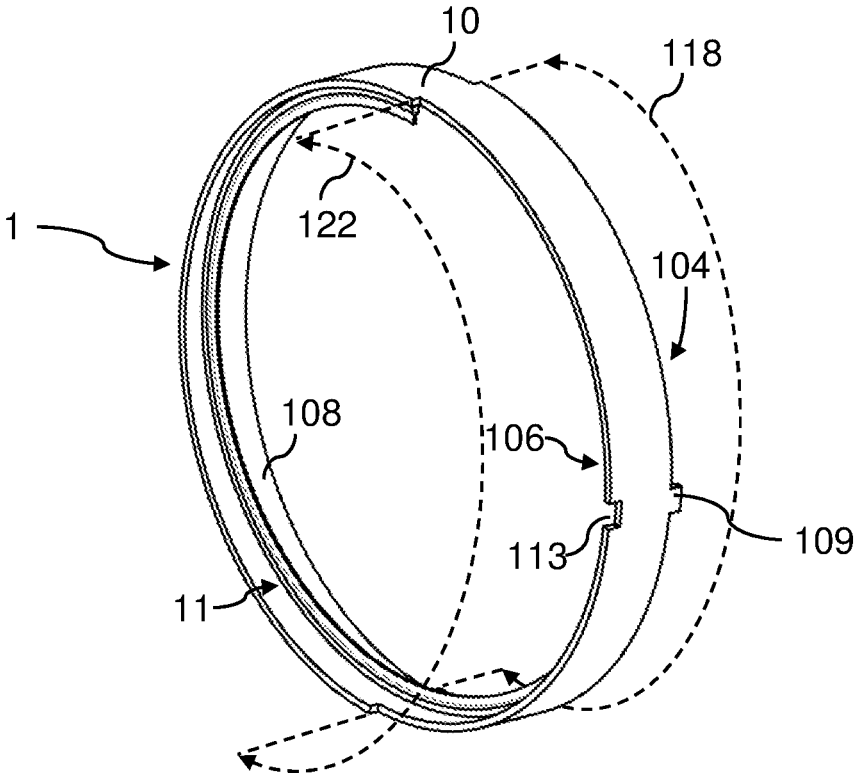
FIG. 2 is a perspective view of a first exemplary embodiment of a dimensionally stable ring element according to the invention.

As can be seen in FIG. 1, an exemplary embodiment of an agitator ball mill 4 according to the invention comprises a grinding container 5, in which there is arranged an agitator for grinding the material to be ground. The agitator can be connected via a belt drive to a motor driving the agitator. The grinding container has a material input for the material to be ground and a material output for the ground material. The agitator ball mill 4 also comprises a heat exchanger casing 3, which is arranged around a cylindrical container wall 50 of the grinding container 5. The heat exchanger casing 3 comprises a plurality of dimensionally stable ring elements 1 (see FIG. 2-5) or a plurality of dimensionally stable ring elements 2 (see FIGS. 9 and 10), which are arranged one after the other in a row in the direction of a cylinder axis 102 (see, for example, FIG. 3) or in the direction of a cylinder axis 202 (see, for example, FIG. 10), respectively. The heat exchanger casing 3 comprising the plurality of ring elements 1 or the plurality of ring elements 2 is shown in FIG. 6 to 8 and FIG. 11 and is described in greater detail hereinbelow. In addition, the agitator ball mill 4 has an inlet 40 and an outlet 42 for a heat transfer medium, for example water. The inlet 40 and the outlet 42 is described in greater detail hereinbelow in connection with the heat exchanger casing 3.

FIG. 2, FIG. 3, FIG. 4 and FIG. 5 show a first exemplary embodiment of a dimensionally stable ring element 1 used in the heat exchanger casing 3 of the agitator ball mill 4. Such a dimensionally stable ring element 1 comprises a cylindrical sleeve 10 having the cylinder axis 102 and a first end 104 as well as a second end 106 remote from the first end 104. The dimensionally stable ring element 1 further comprises a dividing wall 11, which projects inwards from an inner wall 108 of the cylindrical sleeve 10 and extends helically around the cylinder axis 102 along the inner wall 108 from the first end 104 to the second end 106. The cylindrical sleeve 10 can be made, for example, from polyamide, which has a first modulus of elasticity. Good dimensional stability of the sleeve 10 can be achieved if fibre-reinforced, for example glass-fibre-reinforced, polyamide is chosen as material for the cylindrical sleeve 10.

Figure 4:
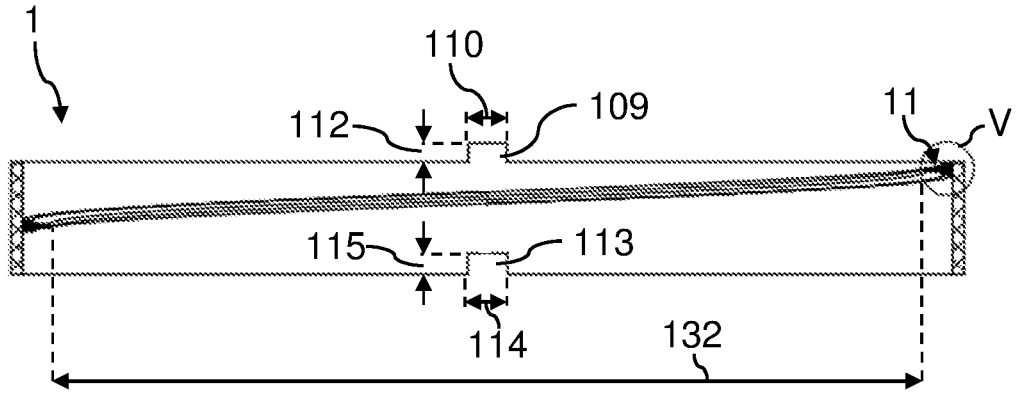
FIG. 4 shows a longitudinal section through the dimensionally stable ring element from FIG. 2.

At its first end 104 the cylindrical sleeve 10 has a tooth 109 extending parallel to the cylinder axis 102, as can be seen especially clearly in FIG. 4. Furthermore, at its second end 106 the cylindrical sleeve 10 has a notch 113 extending parallel to the cylinder axis 102 and complementary in shape to the tooth 109. The tooth 109 has a tooth length 112 and a tooth width 110, and the notch has a notch depth 115 corresponding to the tooth length 112 and a notch width 114 corresponding to the tooth width 110.

Figure 3:
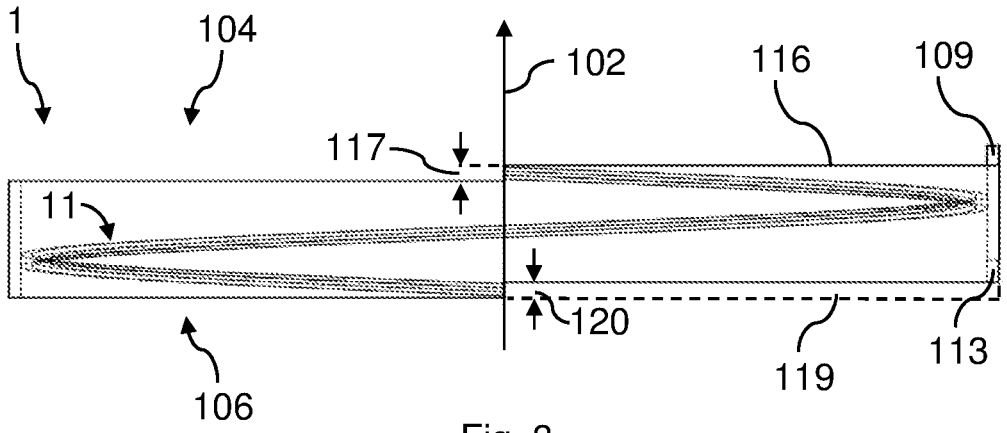
FIG. 3 is a side view of the dimensionally stable ring element from FIG. 2.

Furthermore, the cylindrical sleeve 10 has, at the first end 104, an overhang 116 extending along the circumference of the sleeve, as can readily been seen in FIG. 3. The cylindrical sleeve 10 also has, at its second end 106, a cutaway 119 complementary in shape to the overhang, which cutaway is indicated in dashed lines in FIG. 3. The overhang 116 has an overhang length 118 (see FIG. 2) in the direction of the circumference of the sleeve and an overhang width 117 in the direction of the cylinder axis 102 (see FIG. 3). The cutaway 119 has a cutaway length 122 (see FIG. 2) corresponding to the overhang length 118 and a cutaway depth 120 (see FIG. 3) corresponding to the overhang width 117.

Figure 5:
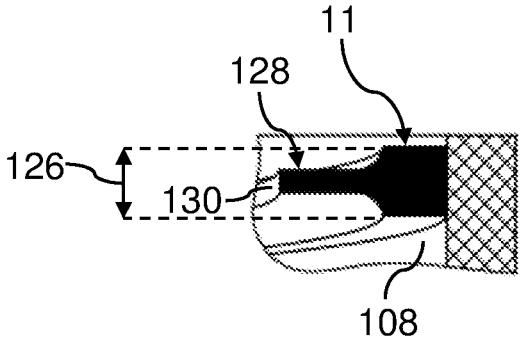
FIG. 5 is an enlarged view of the detail V from FIG. 4.

FIG. 5 shows the detail V from FIG. 4 on a slightly enlarged scale, so that the dividing wall 11 of the dimensionally stable ring element 1 can be seen more clearly. The dividing wall 11 can extend helically around the cylinder axis 102 from the overhang 116 at the first end 104 of the sleeve 10 to the cutaway 119 at the second end 106 of the sleeve 10. The dividing wall 11 has a dividing wall width 126, which is smaller than or equal to the overhang width 117 of the overhang 116. Furthermore, the dividing wall 11 has a flexible sealing lip 128 at its end remote from the inner wall 108 of the cylindrical sleeve 10, as can also be seen in FIG. 8.

Figure 8:
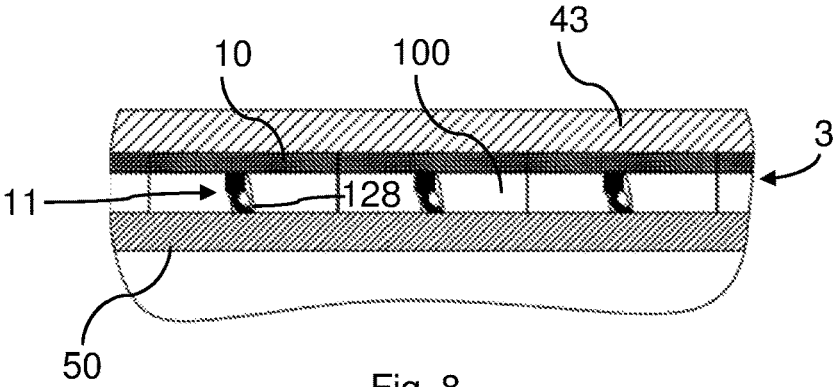
FIG. 8 is an enlarged view of the detail VIII from FIG. 7.

The flexible sealing lip 128 has an inner edge 130 which defines an internal diameter 132 (see FIG. 4) of the dividing wall 11 which runs helically around the cylinder axis 102. In the exemplary embodiment shown, that internal diameter 132 is smaller than the external diameter 500 of the cylindrical container wall 50 of the grinding container 5. That difference in diameter has the result that when the dimensionally stable ring element 1 is arranged around the container wall 50, the flexible sealing lip 128 rests in a bent state against the container wall 50 of the grinding container 5, as can be seen in FIG. 8.

The dividing wall 11 can be made from a thermoplastic elastomer which has a second modulus of elasticity, the second modulus of elasticity of the thermoplastic elastomer of the dividing wall 11 being smaller than the first modulus of elasticity of the polyamide of the sleeve 10. The sleeve 10 and the dividing wall 11 can have been made, for example, by a two-component injection-moulding process.

In such a two-component injection-moulding process, in a first step the sleeve 10 is injection-moulded from polyamide and then the dividing wall 11 is injection-moulded in a second step. Various measures can be taken to ensure that the dividing wall 11 is firmly seated in the sleeve 10. For example, the sleeve 10 can have a region of contact with the dividing wall 11, which region, after the injection-moulding of the dividing wall 11, forms an insoluble interlocking connection with the dividing wall 11.

Figure 6:
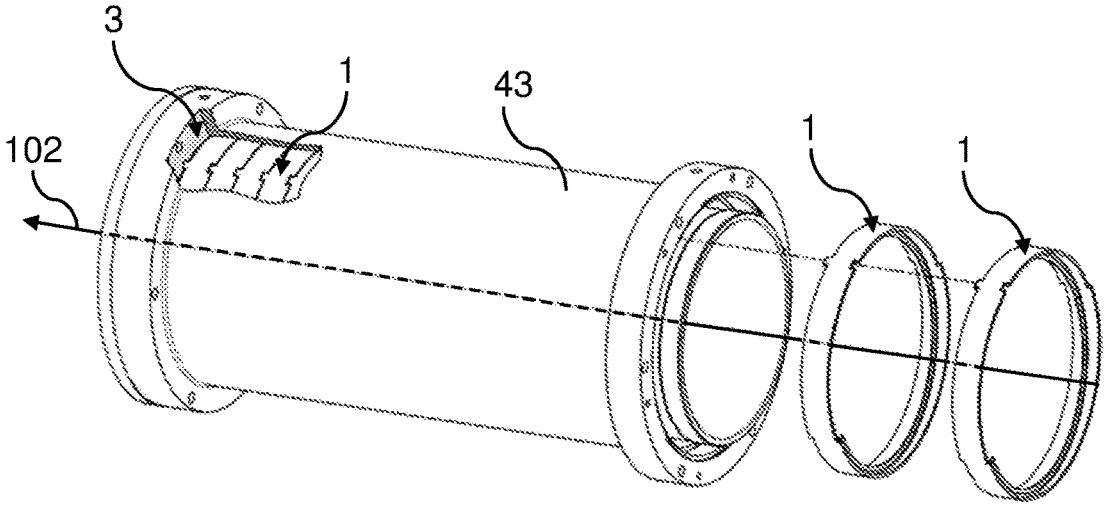
FIG. 6 is a perspective view of the heat exchanger casing with a cylindrical outer cover.

A heat exchanger casing 3 is formed by a plurality of dimensionally stable ring elements 1 which are arranged one after the other in a row in the direction of the cylinder axis 102. This allows the tooth 109 and the overhang 116 of a ring element 1 arranged subsequently in the row to engage interlockingly in the notch 113 and in the cutaway 119, respectively, of the respective preceding ring element 1 in the row. FIG. 6 shows such a row of inter-engaged dimensionally stable ring elements 1 which have been inserted into an outer cover 43. For that purpose, for the purpose of better understanding a "window" has been inserted in outer cover 43 in the drawing, through which the engagement of the teeth in the notches of the dimensionally stable ring elements 1 arranged one after the other in a row is visible. FIG. 6 also shows that the first dimensionally stable ring element 1 inserted into the outer cover 43 engages by means of its tooth 109 in an exactly fitting notch present in the outer cover 43 (or in a flange of the outer cover). Such engagement of the tooth 109 of the first dimensionally stable ring element 1 in the notch in the flange of the outer cover 43 enables the entire row of dimensionally stable ring elements 1 to be secured against twisting.

Furthermore, the outer cover 43 is screwed at its opposite ends to a first end ring 44 and a second end ring 45 (see FIG. 7), which seal the container wall 50 from the outside at the respective ends and accordingly ensure that the heat transfer medium flows through the inlet 40 into one end 101 of the helical channel 100, through the helical channel 100 and out of the outlet 42 again through the other end 103 of the helical channel 100. In addition, the dimensionally stable ring elements 1 of the heat exchanger casing 3 are held together in the axial direction by the second end ring 45 in order to ensure that they are secured against twisting (engagement of the tooth in the outer cover 43 at the other end).

Figure 7:
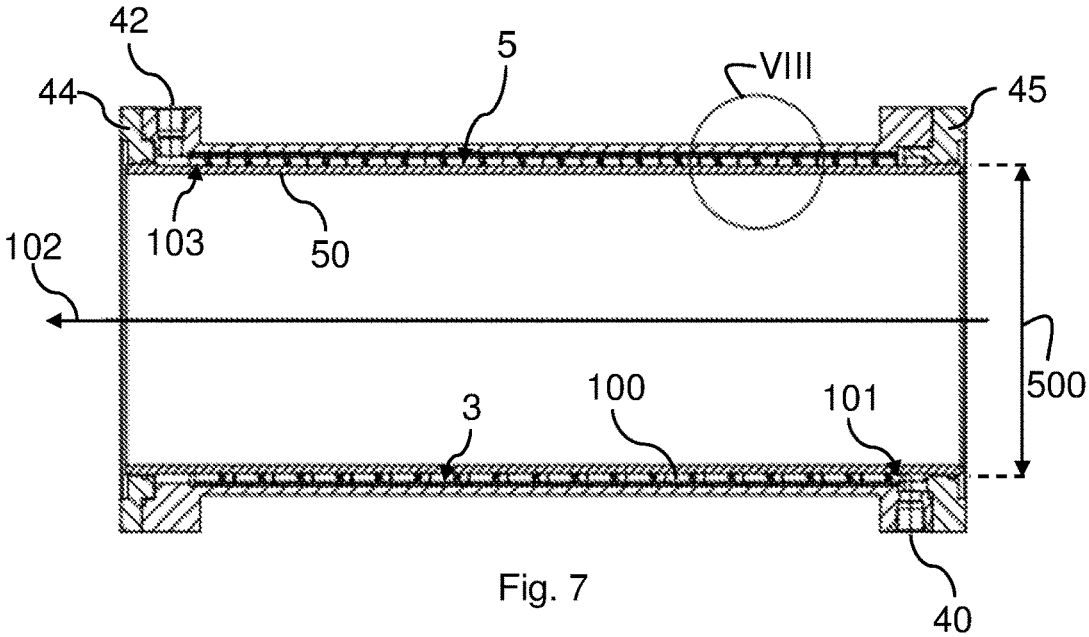
FIG. 7 shows a longitudinal section through the heat exchanger casing with the cylindrical outer cover from FIG. 6 on a grinding container.

FIG. 7 and FIG. 8 show that when the heat exchanger casing 3 is arranged around the container wall 50 of the grinding container 5, the dimensionally stable ring elements 1 with the dividing walls 11 extending helically around the cylinder axis, together with the container wall 50, form a helical channel 100. The helical channel 100 has a first end 101 and a second end 103 remote from the first end. The inlet 40 for the heat transfer medium of the agitator ball mill 4 is connected to the first end 101 of the helical channel 100, and the outlet 42 for the heat transfer medium is connected to the second end 103 of the helical channel 100. Accordingly, the heat transfer medium, for example water, is able to flow through the helical channel 100 from the inlet 40 to the outlet 42. The water is in direct contact with the container wall 50 of the grinding container 5, with the result that especially good heat exchange (for example cooling) of the container wall 50 can be achieved. The throughflow direction of the water through the helical channel 100 can be opposite to the bending direction of the flexible sealing lip 128. This has the result that the water flowing through the helical channel 100 in the opposite direction to the bending direction of the sealing lip 128 presses the flexible sealing lip 128 even more firmly against the container wall 50, thus further supporting the sealing tightness of the helical channel 100.

Figure 9:
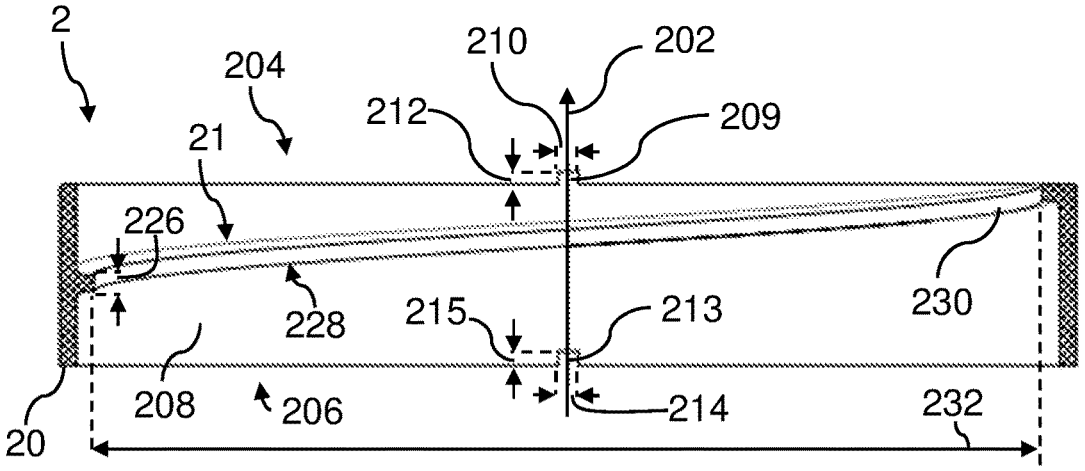
FIG. 9 shows a longitudinal section through a second exemplary embodiment of the dimensionally stable ring element according to the invention.
Figure 10:
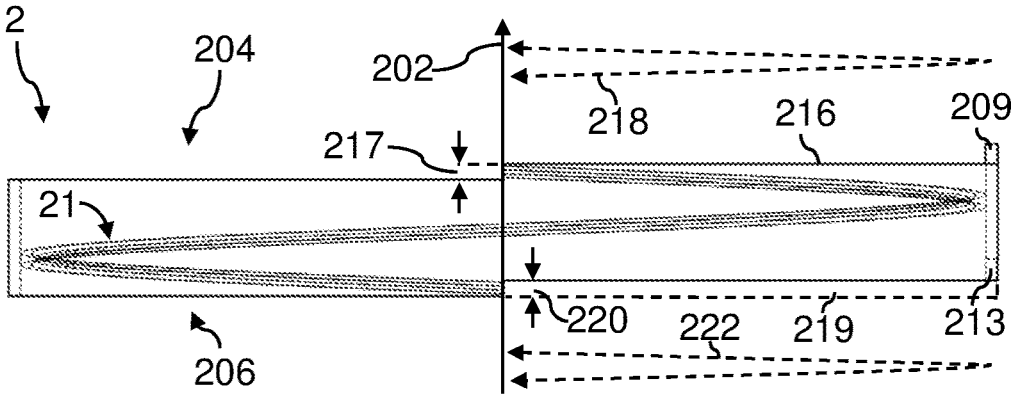
FIG. 10 is a side view of the second exemplary embodiment of the dimensionally stable ring element according to the invention.
Figure 11:
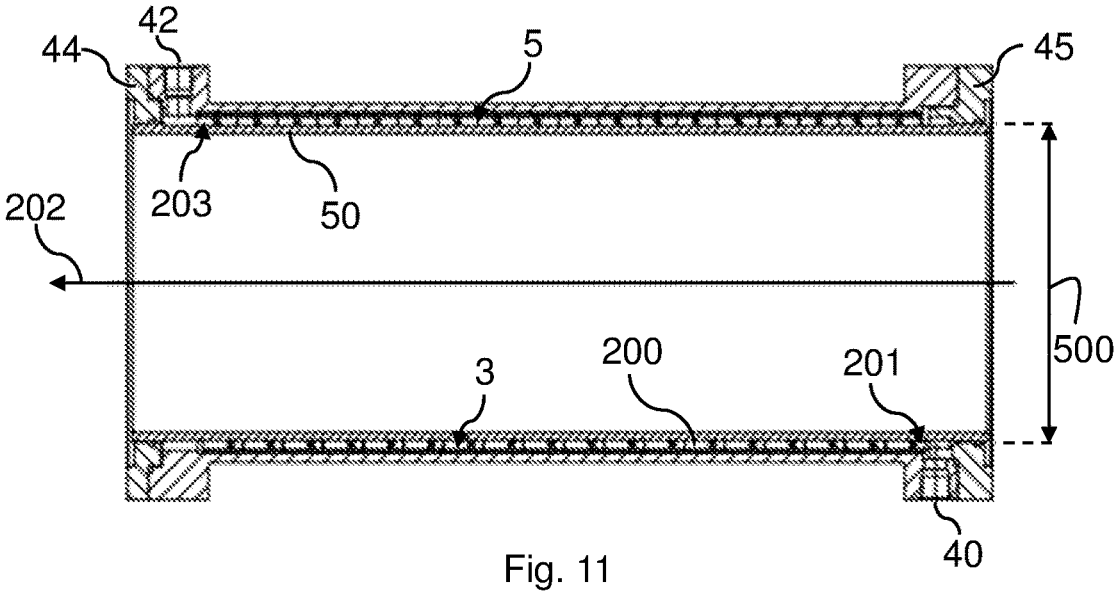
FIG. 11 shows a longitudinal section through a heat exchanger casing of the second exemplary embodiment of the dimensionally stable ring element according to the invention on a grinding container.

FIG. 9, FIG. 10 and FIG. 11 each shows a second exemplary embodiment of the dimensionally stable ring element 2 and of a heat exchanger casing 3 having dimensionally stable ring elements 2 of the second exemplary embodiment of the invention. Some of the aspects already discussed in relation to the first embodiment apply likewise to the second embodiment, so that those aspects and their function will not be explained again here. In this regard reference is made to the corresponding parts of the description of the first exemplary embodiment.

In the second embodiment, the dimensionally stable ring element 2 comprises a cylindrical sleeve 20 having the cylinder axis 202 and a first end 204 as well as a second end 206 remote from the first end. The dimensionally stable ring element 2 comprises a (dimensionally stable) dividing wall 21 which projects inwards from an inner wall 208 of the cylindrical sleeve 20 and extends helically around the cylinder axis 202 along the inner wall 208 from the first end 204 to the second end 206. The cylindrical sleeve 20 can be made, for example, from polyamide. In particular, the sleeve 20 and the dividing wall 21 can both be injection-moulded from polyamide in a single step with the aid of a one-component injection-moulding process.

At its first end 204 the cylindrical sleeve 20 has a tooth 209 extending parallel to the cylinder axis 202. At its second end 206 the cylindrical sleeve 20 likewise has a notch 213 extending parallel to the cylinder axis 202 and complementary in shape to the tooth 209. The tooth 209 has a tooth length 212 and a tooth width 210, and the notch has a notch depth 215 corresponding to the tooth length 212 and a notch width 214 corresponding to the tooth width 210.

Furthermore, the cylindrical sleeve 20 comprises, at the first end 204, an overhang 216 extending along the circumference of the sleeve. The sleeve likewise has, at its second end, a cutaway 210 complementary in shape to the overhang. The overhang 216 has an overhang length 218 (see FIG. 10) in the direction of the circumference of the sleeve and an overhang width 217 in the direction of the cylinder axis 202. The cutaway 219 has a cutaway length 222 (see FIG. 10) corresponding to the overhang length 218 and a cutaway depth 220 corresponding to the overhang width 217.

The dividing wall 21 extends helically around the cylinder axis 202 from the overhang 216 at the first end 204 of the sleeve 20 to the cutaway 219 at the second end of the sleeve 20 and has a dividing wall width 226 (see FIG. 9) that is smaller than or equal to the overhang width 217 of the overhang 216. Furthermore, the dividing wall 21 has a dimensionally stable bead 228 which projects inwards from the inner wall 208 of the sleeve 20.

The dimensionally stable bead 228 has an inner edge 230 having an internal diameter 232, that internal diameter 232 being larger than the external diameter 500 of the container wall 50 of the grinding container 5, so that a narrow gap is formed between the inner edge 230 of the dimensionally stable bead 228 and the container wall 50 of the grinding container 5. The very slightly larger internal diameter 232 at the inner edge 230 of the dimensionally stable bead 228 prevents the (dimensionally stable and therefore inflexible) dividing wall 21 of the cylindrical sleeve 20 from being damaged during mounting on the grinding container 5. Although the narrow gap formed in that way means that very slight leakage is possible, the heat transfer medium, apart from that very slight leakage, nevertheless flows through the helical channel similarly to the first exemplary embodiment, so that the mode of action is in principle the same as in the first exemplary embodiment.

The assembly of the heat exchanger casing 3 with dimensionally stable ring elements 2 in accordance with the second exemplary embodiment is identical to the assembly of the heat exchanger casing 3 with dimensionally stable ring elements 1 in accordance with the first exemplary embodiment.

The invention has been explained above with reference to exemplary embodiments. It will be clear, however, that the invention is not limited to those exemplary embodiments, but rather those exemplary embodiments serve merely for an understanding of the invention, so that modifications and/or additional aspects can be provided without departing from the teaching of the invention. The scope of protection is therefore defined by the following patent claims.

The invention claimed is:

1. An agitator ball mill, comprising:

a grinding container having a container wall that is cylindrical, a heat exchanger casing having a plurality of ring elements, each ring element of the plurality of ring elements being dimensionally stable and having:

a cylindrical sleeve having a cylinder axis, a first end and a second end remote from the first end, and having an inner wall, and a dividing wall which projects inwards from the inner wall of the sleeve and extends helically around the cylinder axis along the inner wall from the first end of the sleeve to the second end of the sleeve, wherein the sleeve, at a first end of the sleeve, comprises a projection extending parallel to the cylinder axis, which projection is arranged in a predetermined circumferential position on the sleeve, and wherein the sleeve, at a second end of the sleeve, comprises a recess extending parallel to the cylinder axis, which recess has a shape complementary to the projection and is arranged on the sleeve in the same predetermined circumferential position as the projection, wherein the ring elements of the plurality of ring elements are arranged one after the other in a row in the direction of the cylinder axis, with the projection of a ring element of the plurality of ring elements that is arranged subsequently in the row interlockingly engaging in the recess of a respective preceding ring element of the plurality of ring elements arranged in the row, wherein the heat exchanger casing is arranged around the container wall, so that a helical channel is formed by the dividing walls of the ring elements of the heat exchanger casing extending helically around the cylinder axis and by the container wall, and an inlet and an outlet for a heat transfer medium, the inlet being connected to a first end of the helical channel and the outlet being connected to a second end of the helical channel of the heat exchanger casing, which second end is remote from the first end.

2. The agitator ball mill of claim 1, further comprising a cylindrical outer cover which encompasses the heat exchanger casing.

3. The agitator ball mill of claim 1 wherein:

the dividing wall of each ring element of the plurality of ring elements of the heat exchanger casing has a flexible sealing lip at its end remote from the inner wall of the sleeve, the flexible sealing lip has an inner edge having an internal diameter and the container wall of the grinding container has an external diameter, the internal diameter of the sealing lip being smaller than the external diameter of the container wall of the grinding container, so that the flexible sealing lip is bent and rests against the container wall of the grinding container.

4. The agitator ball mill of claim 1 wherein:

the dividing wall of each ring element of the plurality of ring elements of the heat exchanger casing is in the form of a dimensionally stable bead running helically around the cylinder axis, which bead projects inwards from the inner wall of the sleeve, the dimensionally stable bead has an inner edge having an internal diameter and the container wall of the grinding container has an external diameter, the internal diameter of the bead being larger than the external diameter of the container wall of the grinding container, so that a gap is formed between the inner edge of the bead and the container wall of the grinding container.

5. The agitator ball mill of claim 1, wherein the projection at the first end of the sleeve has a tooth having a tooth length and a tooth width, and wherein the recess at the second end of the sleeve has a notch having a notch depth and a notch width, the tooth having a shape complementary to the notch, and the tooth length corresponding to the notch depth and the tooth width corresponding to the notch width.

6. The agitator ball mill of claim 1, wherein the projection at the first end of the sleeve comprises an overhang extending along a circumference of the sleeve, which overhang has an overhang length in the direction of the circumference of the sleeve and an overhang width in the direction of the cylinder axis, and wherein the recess at the second end of the sleeve comprises a cutaway extending in the direction of the circumference of the sleeve, which cutaway has a cutaway length in the direction of the circumference of the sleeve and a cutaway depth in the direction of the cylinder axis, the overhang having a shape complementary to the cutaway, and the overhang length corresponding to the cutaway length and the overhang width corresponding to the cutaway depth.

7. The agitator ball mill of claim 6, wherein the dividing wall extends helically around the cylinder axis from the overhang at the first end of the sleeve to the cutaway at the second end of the sleeve, and wherein the dividing wall has a dividing wall width extending parallel to the cylinder axis, which dividing wall width is smaller than or equal to the overhang width.

8. The agitator ball mill of claim 1, wherein the dividing wall has a flexible sealing lip at an end of the dividing wall remote from the inner wall of the sleeve.

9. The agitator ball mill of claim 8, wherein the sleeve is made from a first material having a first modulus of elasticity and the dividing wall is made from a second material having a second modulus of elasticity, the first modulus of elasticity of the material of the sleeve being greater than the second modulus of elasticity of the material of the dividing wall.

10. The agitator ball mill of claim 9, wherein the sleeve made from the first material with the dividing wall made from the second material is manufactured by a two-component injection-moulding process.

11. The agitator ball mill of claim 1, wherein the dividing wall is in the form of a dimensionally stable bead running helically around the cylinder axis, which bead projects inwards from the inner wall of the sleeve.

12. The agitator ball mill of claim 11, wherein the sleeve and the dividing wall are manufactured from the same material by a one-component injection-moulding process.

* * * * *